United States Patent [19]

van Thiel

[11] 4,233,364

[45] Nov. 11, 1980

[54] ANCHORING FIBRE FOR USE IN CONCRETE

[75] Inventor: Rudolphus A. F. J. van Thiel, Beek en Donk, Netherlands

[73] Assignee: Van Thiel's Draadindustrie (Thibodraad) B.V., Beek en Donk, Netherlands

[21] Appl. No.: 39,211

[22] Filed: May 15, 1979

Related U.S. Application Data

[63] Continuation-in-part of Ser. No. 927,953, Jul. 25, 1978, abandoned.

[51] Int. Cl.[2] ..... D02G 3/00

[52] U.S. Cl. ..... 428/399; 52/659; 428/400

[58] Field of Search ..... 428/397, 399, 400, 379, 428/554, 582, 583, 584, 606, 603, 592, 364; 52/659

[56] References Cited

U.S. PATENT DOCUMENTS

| | | | |
|---|---|---|---|
| 3,053,713 | 9/1962 | Juras | 428/379 X |
| 3,313,560 | 4/1967 | Macchi | 403/333 |
| 3,553,003 | 1/1971 | Carlton et al. | 428/400 X |
| 3,592,727 | 7/1971 | Weaver et al. | 428/399 |
| 3,684,474 | 8/1972 | Chrisholm | 52/659 X |
| 3,846,085 | 11/1974 | Dunn, Jr. | 428/583 |
| 3,936,278 | 2/1976 | Moens | 428/592 |
| 3,942,955 | 3/1976 | Moens | 52/659 X |
| 3,953,185 | 4/1976 | Aoki et al. | 428/372 X |
| 3,953,953 | 5/1976 | Marsden | 428/603 |

FOREIGN PATENT DOCUMENTS

| | | | |
|---|---|---|---|
| 252975 | 6/1926 | United Kingdom | 52/659 |
| 1328568 | 8/1973 | United Kingdom . | |
| 1446855 | 8/1976 | United Kingdom | 52/659 |
| 1452303 | 10/1976 | United Kingdom . | |

*Primary Examiner*—Lorraine T. Kendell

*Attorney, Agent, or Firm*—Irvin A. Lavine

[57] ABSTRACT

An anchoring fibre of metal to be used in concrete, having a flattened end and a transversely extending projection on the end. The flattened end may be either rectangular or triangular in planform, and the projections may be either pyramidal or a flange. The body may have protuberances extending therefrom.

11 Claims, 4 Drawing Figures

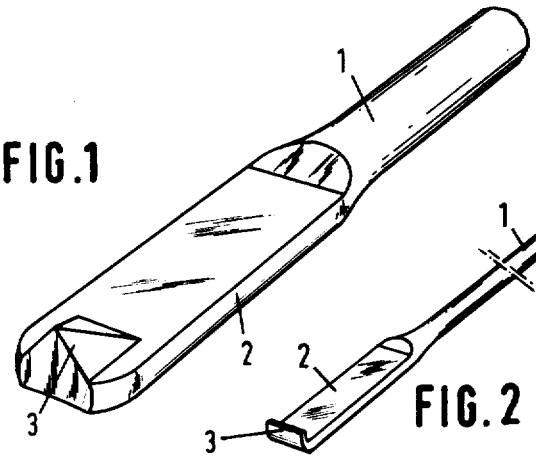
FIG.1
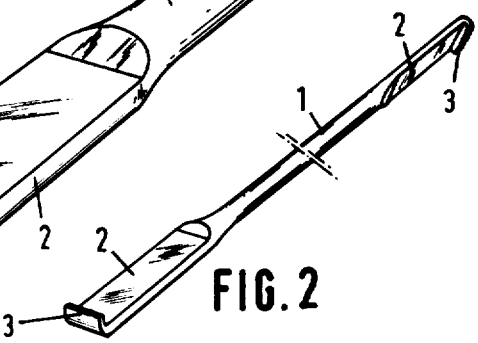
FIG.2
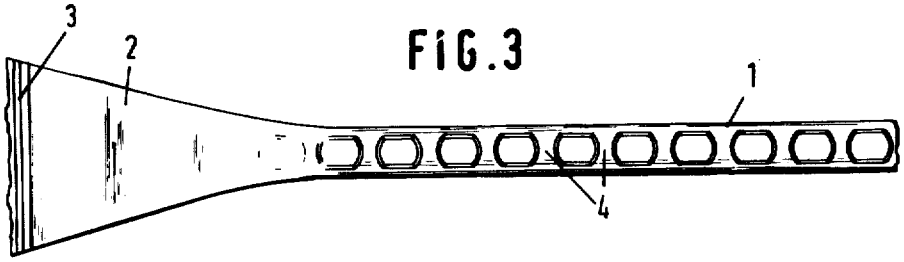
FIG.3
FIG.4
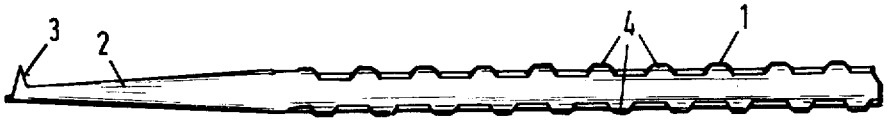

ANCHORING FIBRE FOR USE IN CONCRETE

The present invention is a continuation-in-part of Application Ser. No. 927,953, filed July 25, 1978 now abandoned.

The present invention relates to an anchoring fibre, made of metal, for use in connection with concrete.

Anchoring fibres have been used in connection with various plastic masses, and have been made of a number of substances. British Pat. No. 1,446,855 discloses a wire anchoring fibre having ends which are flattened, or thickened, or having ends which are bent, being co-planar with the wire and having a cross-head. Dutch Patent Application No. 69,13898 discloses a wire having bent end portions, and also discloses a wire which is corrugated along its length. Dutch Application No. 73,16255 discloses wire having ends which are bent, and in some instances ends which are flattened. French Pat. No. 1,319,156 discloses a wire which is somewhat flattened from the cylindrical, and which appears to have conical end portions.

WEAVER et al., U.S. Pat. No. 3,592,727, discloses a reinforcing wire which is provided along its length with protuberances extending generally perpendicularly to the axis of the wire.

In addition, plastic reinforcing elements are known, CARLTON et al., U.S. Pat. No. 3,553,003 discloses a fibre having a cylindrical body with generally spherical ends, and this is similar to CHISHOLM, U.S. Pat. No. 3,684,474 which also discloses reinforcing fibres of this shape, or bent into a U-shape or a modified Z-shape.

The above fibres do not provide sufficient holding power, when embedded in a mass, particularly of concrete.

The present invention is directed to an anchoring fibre which is made of metal and which is to be used in concrete. There is provided a fibre having a generally cylindrical body with its ends flattened. The flattened end may be generally rectangular in planform, or it may be triangular, with the wider portion remote from the end of the cylindrical body. The flattened end portion is provided at its free end or terminal portion with a projection extending transversely of the flattened end portion, the projection being either pyramidal, or in the form of a flange having a central plane generally perpendicular to the flattened end portion. The flattened end portions may be provided so that they are parallel to planes which are non-parallel, and in particular the planes may be substantially perpendicular to each other. Further, the cylindrical body of the fibre itself may have protrusions on it, such as a line or series of protuberances extending generally perpendicular to the axis of the cylindrical body, and in particular plural lines of protuberances may be provided.

Among the objects of the herein disclosed anchoring fibre are to provide such a fibre which has a substantially larger resistance to pull-out.

In the drawings:

FIG. 1 is a perspective view of an anchoring fibre in accordance with the present invention, with parts broken away.

FIG. 2 is a perspective view of a second enbodiment of the anchoring fibre in accordance with the invention, with parts removed.

FIG. 3 is a top plan view of another embodiment of an anchoring fibre in accordance with the present invention.

FIG. 4 is a side view of the anchoring fibre shown in FIG. 3.

Referring now to the drawings, wherein like or corresponding reference numerals are used to designate like or corresponding parts, throughout the several views, there is shown in FIG. 1 an anchoring fibre, or more particularly, a portion of an anchoring fibre, which includes a longitudinally extending body 1, having a second end portion 2 which is of generally rectangular planform. At the extremity of the flattened portion 2, that is at the free end thereof, there is provided a projection 3 which extends transversely of the axis of the body 1, and which is in the shape of a pyramid. An anchoring fibre constructed in accordance with FIG. 1 has a strong resistance to pull-out.

Referring now to FIG. 2, there is shown an alternate embodiment in which there is the aforementioned longitudinally extending cylindrical body 1 having the ends thereof provided with flattened end portions 2. Each end portion 2 at the free end thereof has a projection in the shape of a flange 3, the flanges 3 lying in planes which are generally perpendicular to a plane which is parallel to the adjacent flattened end portions 2, respectively. As is clearly shown in FIG. 2, the two flattened end portions 2 are non-parallel, and, as shown, are each parallel to planes which are mutually perpendicular. It will be observed that the flattened end portions 2 as shown in FIG. 2 are of generally rectangular planform.

Referring now to FIG. 3, there will be seen an anchoring fibre in which there is a longitudinally extending generally cylindrical body 1, having at the end a flattened end portion 2 which is of generally triangular planform, so that there is a narrow portion thereof adjacent the body 1, and a wider terminal portion remote from the body 1. The flattened end portion 2 diverges from the narrow portion to the wider portion thereof as is clearly shown in FIG. 3. At the free end of the flattened end portion 2 there extend flanges substantially transversely thereof, and generally perpendicular to the axis of the body 1. In addition, the body 1 is provided with protuberances 4, as shown in FIG. 3, which extend in a line along a portion of the body 1, and as will be seen from FIG. 4, there are plural lines of said protuberances 4. The embodiment shown in FIGS. 3 and 4 has markedly improved holding power against pull-out, this being believed to be a result of both the generally triangular configuration of the flattened end portion 2, together with the flange 3, and, in addition, the protuberances 4.

There have been disclosed anchoring fibres of metal which are useful in particular in connection with concrete, each characterized by a substantially cylindrical body having flattened end portions, with transversely extending projections on the end portions. The projections may be either pyramidal or transverse flanges, and the flattened end portions may be either of rectangular or triangular planform.

I claim:

1. An anchoring fibre of metal for use in concrete comprising a longitudinally extending cylindrical body, said fibre having means thereon to resist pull-out thereof from the concrete, said means comprising the end portions of the fibre being flattened, and a projection on a said flattened end portion, said projection extending transversely of the axis of said body.

2. An anchoring fibre in accordance with claim 1, wherein said projection is at the free end of said end portion.

3. An anchoring fibre in accordance with claim 2, wherein said projection is in the shape of a pyramid.

4. An anchoring fibre in accordance with claim 1, wherein said projection is in the shape of a flange.

5. An anchoring fibre in accordance with claim 4, wherein said flange lies in a plane substantially perpendicular to a plane parallel to the flattened end portion of said body.

6. An anchoring fibre in accordance with claim 1, wherein said fibre has both end portions flattened, each end portion has a projection in the shape of a flange lying in a plane substantially perpendicular to a plane parallel to the adjacent flattened end of said body, said flattened ends being non-parallel.

7. The anchoring fibre in accordance with claim 1, wherein said flattened end portion is rectangular in planform.

8. An anchoring fibre in accordance with claim 1, wherein said flattened end portion has a narrow portion adjacent said body and diverges therefrom to a wider terminal portion, said projection being a flange at said terminal portion.

9. An anchoring fibre in accordance with claim 8, wherein said body has protuberances extending transversely of the axis thereof.

10. An anchoring fibre in accordance with claim 9, wherein said protuberances extend in a line along at least a portion of the length of said body.

11. An anchoring fibre in accordance with claim 9, wherein said protuberances extend in plural lines along said body.

* * * * *